United States Patent [19]

Fogarty et al.

[11] 4,414,774

[45] Nov. 15, 1983

[54] FASHION AND HAIRSTYLE DOLL PLAY SET

[76] Inventors: A. Edward Fogarty; Bonnie R. Fogarty, both of 3513 School Ave., Sarasota, Fla. 33579

[21] Appl. No.: 377,608

[22] Filed: May 13, 1982

[51] Int. Cl.[3] ..... A63H 3/00

[52] U.S. Cl. ..... 46/22; 46/172

[58] Field of Search ..... 46/22, 115, 116, 157, 46/172; 434/396

[56] References Cited

U.S. PATENT DOCUMENTS

| | | | |
|---|---|---|---|
| 1,255,677 | 2/1918 | Wilt | 46/157 |
| 2,820,326 | 1/1956 | Cohn et al. | 46/172 |
| 2,944,368 | 7/1960 | O'Brien et al. | 46/22 X |
| 3,073,059 | 8/1958 | Doyle et al. | 46/157 |
| 3,205,614 | 9/1965 | Brosk | 46/116 |
| 3,225,489 | 8/1962 | Ryan | 46/172 |
| 3,313,044 | 4/1967 | Glass et al. | 434/396 |
| 3,419,993 | 1/1969 | Rodgers | 46/22 |
| 3,464,146 | 3/1967 | McCurdy | 46/22 |
| 3,668,805 | 6/1972 | Coleman | 46/157 X |
| 3,782,027 | 1/1974 | Goldfarb et al. | 46/22 |
| 3,874,113 | 4/1975 | Beck | 46/161 |
| 4,227,340 | 10/1980 | Goldfarb et al. | 46/157 X |
| 4,319,424 | 3/1982 | Goldfarb et al. | 46/116 |

FOREIGN PATENT DOCUMENTS

| | | | |
|---|---|---|---|
| 1506324 | 11/1967 | France | 46/22 |

*Primary Examiner*—F. Barry Shay

*Attorney, Agent, or Firm*—Benjamin P. Reese, II

[57] ABSTRACT

A fashion and hairstyle doll play set comprising a self-standing, three-dimensional doll and various removably attachable articles simulating clothing, headgear and coiffured natural hair. The doll included in the play set comprises a rigid or semi-rigid body with integrally formed limbs and a semi-rigid or flexible head with an integrally formed sculptured hair design. The waist of the body is configured as a right circular cylinder. The head has an essentially horizontal, encircling recess above the lower periphery of its sculptured hair design. The play set includes at least one semi-rigid or flexible, open-ended, hollow article simulating an article of lower body clothing, such as a skirt, with an integrally formed ring positioned in one of its open ends which flexes to engage the waist of the body of the doll. The play set also includes at least one article simulating both headgear, such as a cap, hat or headband, and coiffured natural hair with a semi-rigid or flexible element which flexes to engage the recess encircling the head of the doll. The play set can also include at least one semi-rigid or flexible article simulating an article of upper body clothing, such as a poncho or vest, which has a pair of parallel, U-shaped elements which flex to engage the shoulders of the body of the doll.

9 Claims, 13 Drawing Figures

FASHION AND HAIRSTYLE DOLL PLAY SET

BACKGROUND OF THE INVENTION

This invention relates generally to a fashion and hairstyle doll play set, and, particularly, to such a play set comprising a self-standing, three-dimensional doll and various removeably attachable articles simulating clothing, headgear and coiffured natural hair.

Various two-dimensional paper dolls and the like having removeably attachable paper clothing are provided by the prior art. The prior art also provides various three-dimensional dolls having removeably attachable cloth clothing. Certain of the three-dimensional dolls provided by the prior art have strands of artificial hair which can be brushed, combed and curled. Neither the two-dimensional paper dolls and their associated paper clothing nor the three-dimensional dolls and their associated cloth clothing which are provided by the prior art have proved to be entirely satisfactory as fashion and hairstyle doll play sets for children in the 3–7 year old age group. In general, children in that age group desire greater realism in their play activities than is possible with two-dimensional paper dolls. However, children in that age group usually lack the manipulative skills which are necessary to removeably attach cloth clothing to a three-dimensional doll to create a new fashion appearance and to brush, comb and curl strands of artificial hair to create a new hairstyle for the doll.

It is desirable to have a fashion and hairstyle doll play set which has a greater realism than is possible with two-dimensional paper dolls but which can be easily manipulated by children in the 3–7 year old age group. Such a play set should preferably include a three-dimensional doll and various articles simulating clothing and headgear which can easily be removeably attached to the doll by children in that age group to change the fashion appearance of the doll. Since children in that age group have difficulty brushing, combing and curling strands of artificial hair, the articles simulating headgear which are included in the play set should preferably have strands of coiffured artificial hair attached thereto. In this manner, the child can change the hairstyle of the doll when she or he changes the headgear of the doll. It is not believed that the prior art provides such a fashion and hairstyle doll play set.

SUMMARY OF THE INVENTION

The present invention provides a fashion and hairstyle doll play set comprising a self-standing, three-dimensional doll and various removeably attachable articles simulating clothing, headgear and coiffured natural hair.

The self-standing, three-dimensional doll of the play set of the present invention comprises a rigid or semi-rigid body with integrally formed limbs and a semi-rigid or flexible head with an integrally formed sculptured hair design. The body is configured such that its arms extend downward from its shoulders at essentially 45° angles, its waist is in the form of a right circular cylinder, and its hips, legs and feet are dimensionally smaller than the diameter of its waist in all horizontal planes there below. The body has indicia simulating clothing and a protrusion on its back above its waist which functions as a stop. The head has an essentially horizontal, encircling recess above the lower periphery of its sculptured hair design.

The play set of the present invention includes at least one semi-rigid or flexible, hollow article simulating an article of lower body clothing, such as a skirt. Each such article has a pair of opposed open ends and an integrally formed ring positioned in one of those open ends. The ring has either an oval configuration or a circular configuration with a pair of diametrically opposed, parallel, flat areas on its interior surface. With either configuration, the inner diameter of the circular portion of the ring is slightly larger than the diameter of the waist of the body of the doll. The ring flexes when it is forced onto the waist to engage the waist, and, thereby, removeably attach the article to the body of the doll.

The play set of the present invention also includes at least one article simulating both an article of headgear, such as a hat, cap or headband, and coiffured natural hair. Each such article has a semi-rigid or flexible element which flexes to engage the encircling recess on the head of the doll, and, thereby, removeably attach the article to the head. Coiffured strands of artificial hair are fixedly attached to each such article. Thus, when the article is removeably attached to the head, both the headgear and the hairstyle of the doll are changed.

The play set of the present invention can also include at least one semi-rigid or flexible article simulating an article of upper body clothing, such as a poncho or vest. Each such article has a pair of parallel, U-shaped elements which flex to engage the shoulders of the body of the doll, and, thereby, removeably attach the article to the body of the doll. The degree of flexibility of the article is dependent on its size and shape. In general, larger articles simulating upper body clothing must have greater flexibility than smaller articles simulating upper body clothing to permit the article to be removeably attached to the body of the doll.

These and many other advantages, features and objects of the present invention will be apparent from the following Brief Description of the Drawings, Detailed Description of the Preferred Embodiment and Claims, and the accompanying Drawings.

DETAILED DESCRIPTION OF THE PREFERRED EMBODIMENT

The preferred embodiment of the fashion and hairstyle doll play set of the present invention illustrated in FIGS. 1–13.

Figure 1:
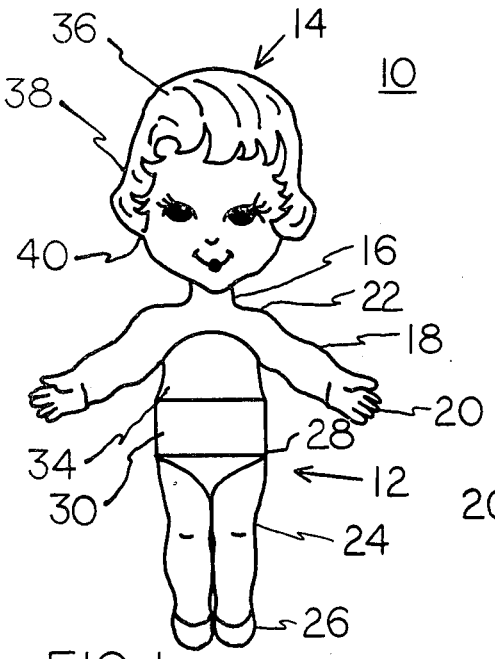
FIG. 1 is a front elevational view of one embodiment of the three-dimensional doll included in the fashion and hairstyle doll play set of the present invention.
Figure 2:
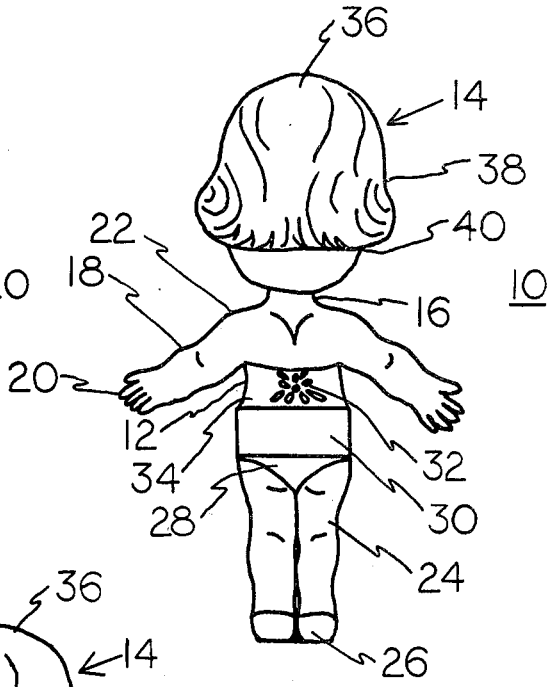
FIG. 2 is a rear elevational view of the doll illustrated in FIG. 1.
Figure 3:
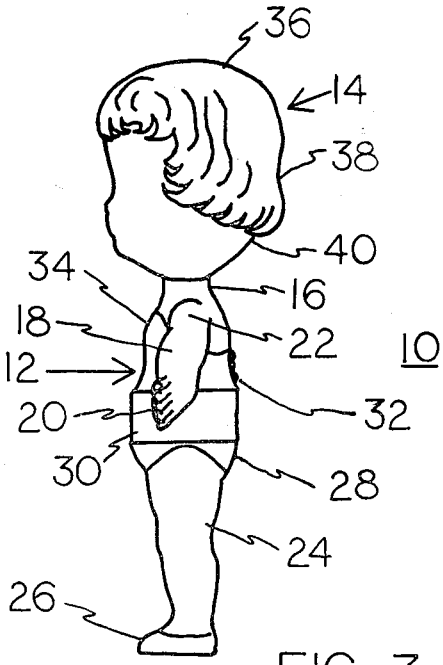
FIG. 3 is a side elevational view of the doll illustrated in FIG. 1.

Referring to FIGS. 1–3, the self-standing, three-dimensional doll 10 which is illustrated comprises a rigid or semi-rigid body 12 and a semi-rigid or flexible head 14. Preferably, both the body 12 and the head 14 are fabricated from suitable plastic materials by conventional molding processes. It is preferable to fabricate the body 12 as a relatively dense, solid component or element and the head 14 as a relatively light, hollow component or element to provide a low center of gravity for the doll 10. If the body 12 and the head 14 are fabricated in this manner, it will be relatively easy for a young child to balance and stand the doll 10 while attaching the various articles which are hereinafter described to the doll 10 during normal play activities with the play set of the present invention.

As illustrated in FIGS. 1–3, the body 12 of the doll 10 has integrally formed limbs, in particular, a neck 16, a pair of arms 18 with hands 20 extending downward from a pair of shoulders 22, and a pair of legs 24 with feet 26 extending downward from a pair of hips 28. The arms 18 extend out from the body and downward from the shoulders 22 at essentially 45° angles to permit the various articles simulating lower body clothing which are hereinafter described to be removeably attached to the waist 30 of the body 12 without interference from the arms 18 and hands 20. The waist 30 of the body 12 is configured as a right circular cylinder. To permit the various articles simulating lower body clothing which are hereinafter described to be removeably attached to the waist 30, the hips 28, legs 24 and feet 26 of the body 12 are dimensionally smaller than the diameter of the waist 30 in all horizontal planes there below. Preferably, at least one protrusion 32 is positioned on the back of the body 12 above the waist 30 to function as an upper stop for the various articles simulating lower body clothing which are hereinafter described. The protrusions 32 which are illustrated in FIG. 2 are arranged in a floral pattern for ornamental purposes. Finally, the body 12 has various permanent indicia 34 simulating clothing.

As illustrated in FIGS. 1–3, the head 14 of the doll 10 has an integrally formed sculptured hair design 36. An essentially horizontal recess 38 encircles the head 14 above the lower periphery 40 of the sculptured hair design 36. As hereinafter described, this encircling recess 38 permits various articles simulating both headgear and coiffured natural hair to be removeably attached to the head 14. The back of the head 14 has a sloped configuration beginning at the lower periphery 40 of the sculptured hair design 36 and ending at the interface between the head 14 and the neck 16 to permit the various articles simulating upper body clothing which are hereinafter described to be removeably attached to the shoulders 22 of the body 12 from the rear thereof. While various ornamental aspects of both the body 12 and the head 14 can be changed substantially without compromising the performance of the doll 10 in its intended use as a component of the play set of the present invention, the functional aspects of the structural features described above are critical to the proper performance of the doll 10.

Figure 4:
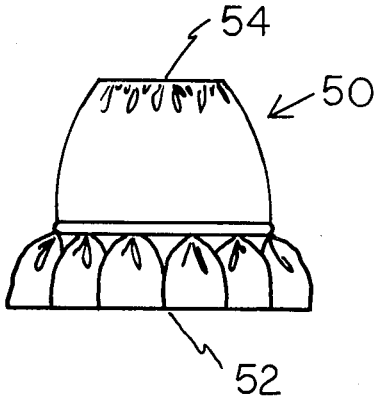
FIG. 4 is an elevational view of one embodiment of an article simulating lower body clothing, in particular, a skirt, included in the fashion and hairstyle doll play set of the present invention.
Figure 5:
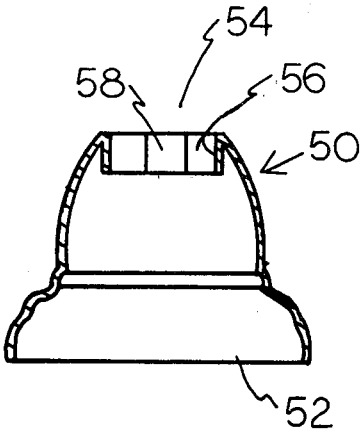
FIG. 5 is an elevational view, in cross section, of the article illustrated in FIG. 4 illustrating an integrally formed ring positioned in its upper end.
Figure 6:
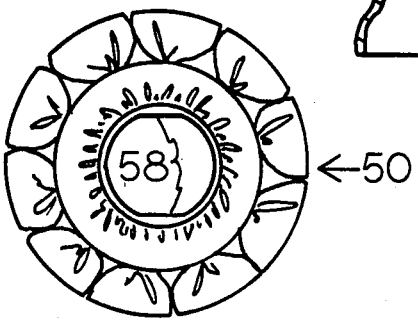
FIG. 6 is a top planar view of the article illustrated in FIG. 4 and FIG. 5 further illustrating the configuration of the integrally formed ring.
Figure 7:
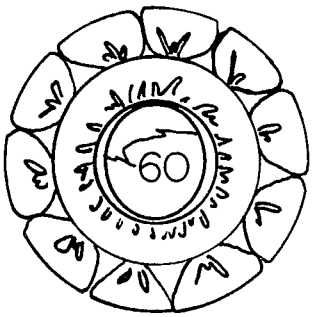
FIG. 7 is a top planar view of an article of the type illustrated in FIG. 4 illustrating an alternate configuration for the integrally formed ring.

Referring to FIGS. 4–6, a semi-rigid or flexible, hollow article 50 simulating lower body clothing, in particular, a skirt, is illustrated. The article 50 has a pair of opposed open ends 52 and 54. As best illustrated in FIG. 5, the inner diameter of the open end 52, and of all other portions, of the article 50 is larger than the largest dimension in any horizontal plane of the feet 26, legs 24 and hips 28 of the body 12 of the doll 10. An integrally formed ring 56 is positioned in the other open end 54 of the article 50. As best illustrated in FIG. 6, the ring 56 has a circular configuration with a pair of diametrically opposed, parallel, flat areas 58 on its interior surface. Alternatively, the ring 56 has an oval configuration as illustrated in FIG. 7. With either configuration, the inner diameter of the circular portion of the ring 56 is slightly larger than the diameter of the waist 30 of the body 12 of the doll 10. And, when the ring 56 is forced onto the waist 30, the flat areas 58 on the interior surface of the ring illustrated in FIG. 6, or the relatively flat areas 60 on the interior surface of the ring illustrated in FIG. 7, flex to engage the waist 30, and, thereby, removeably attach the article 50 to the body 12 of the doll 10 with its upper movement stopped by the protrusions 32 on the back of the body 12. Preferably, the article 50 is fabricated from a suitable plastic material by a conventional molding process.

Figure 8:
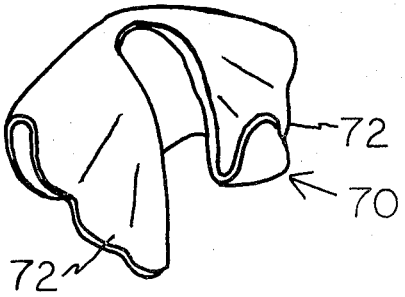
FIG. 8 is a perspective view of an article simulating upper body clothing, in particular, a poncho, included in the fashion and hairstyle doll play set of the present invention.
Figure 9:
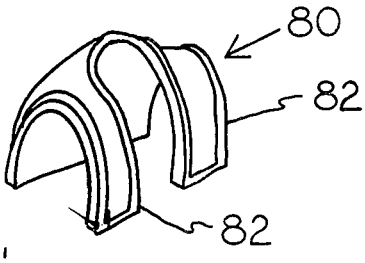
FIG. 9 is a perspective view of an article simulating upper body clothing, in particular, a vest, included in the fashion and hairstyle doll play set of the present invention.
Figure 11:
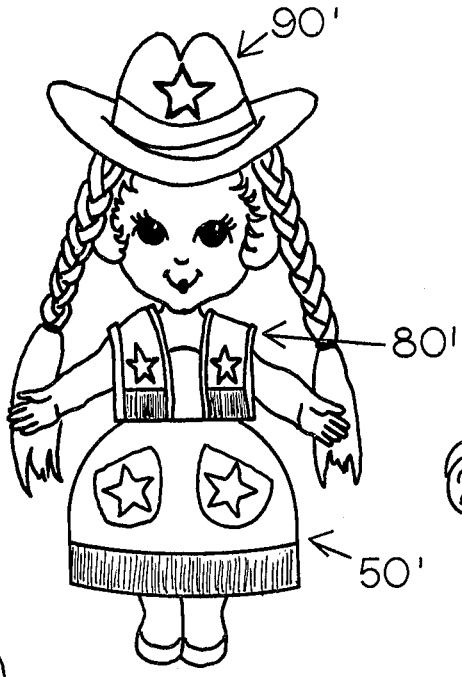
FIG. 11 is a front elevational view of the doll illustrated in FIG. 1, FIG. 2 and FIG. 3 with various articles included in the play set of the present invention removeably attached thereto to simulate the appearance of a cow girl.

Referring to FIG. 8, an article 70 simulating upper body clothing, in particular, a poncho, is illustrated. The article 70 has a pair of parallel, U-shaped elements 72 which flex to engage the shoulders 16 of the body 12 of the doll 10. A similar article 80 simulating upper body clothing, in particular, a vest is illustrated in FIG. 9. The article 80 also has a pair of parallel, U-shaped elements 82 which flex to engage the shoulders 16 of the body 12 of the doll 10. Because of its relatively large size, the article 70 must possess sufficient flexibility for its U-shaped elements 72 to essentially straighten when flexing to engage the shoulders 16. On the other hand, the relatively small size of the article 80 and the sloped configuration of the back of the head 14 of the doll 10 permit the U-shaped elements 82 to engage the shoulders 16 from the rear whether the article 80 is semi-rigid or flexible. Preferably, both the article 70 and the article 80 are fabricated from suitable plastic materials by conventional molding processes. It will be readily appreciated that other articles simulating upper body clothing which are similar to article 70 and article 80 illustrated in FIG. 8 and FIG. 9, respectively. In such case, the degree of flexibility which is necessary for any particular article to be removeably attachable to the shoulders 16 of the body 12 of the doll 10 is dependent on the shape and size of the particular article.

Figure 10:
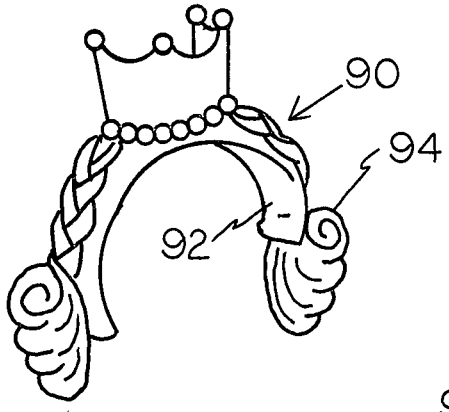
FIG. 10 is a perspective view of an article simulating both an article of headgear, in particular, a decorative headband, and coiffured natural hair included in the fashion and hairstyle doll play set of the present invention.

Referring to FIG. 10, an article 90 simulating both an article of headgear, in particular, a decorative headband, and coiffured natural hair is illustrated. The article 90 has a semi-rigid or flexible element 92 which flexes to engage the encircling recess 38 in the sculptured hair design 36 of the head 14 of the doll 10, and thereby, removeably attach the article 90 to the head 14 of the doll 10. Preferably, the element 92 is fabricated from a suitable plastic material by conventional molding process. Following fabrication of the element 92, coiffured, i.e. brushed, combed and curled, strands 94 of artificial hair are fixedly attached to the element 92 by conventional means, e.g. by adhesive bonding. It will be readily appreciated that other articles simulating both an article of headgear, e.g. a hat or a cap, and coiffured natural hair are possible.

Figure 12:
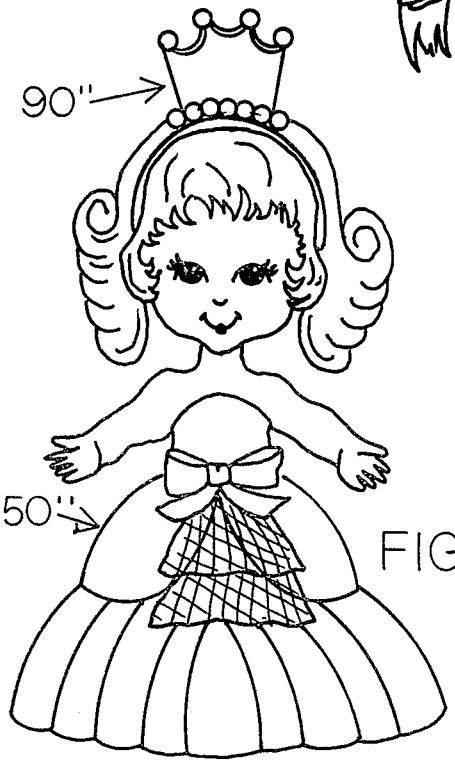
FIG. 12 is a front elevational view of the doll illustrated in FIG. 1, FIG. 2 and FIG. 3 with various articles included in the play set of the present invention removeably attached thereto to simulate the appearance of a princess.
Figure 13:
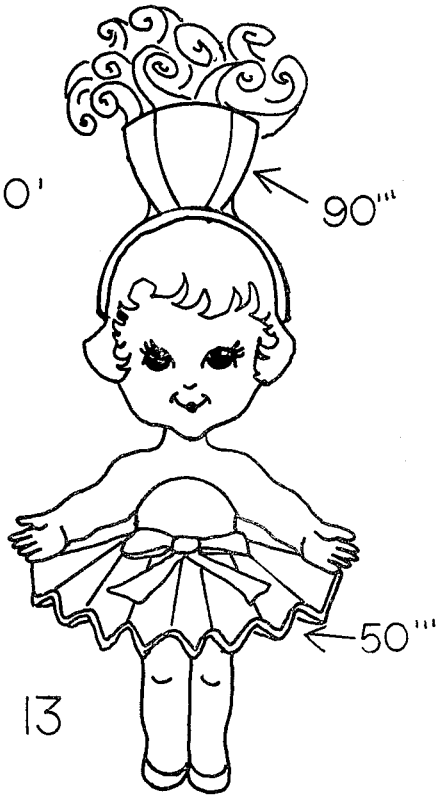
FIG. 13 is a front elevational view of the doll illustrated in FIG. 1, FIG. 2 and FIG. 3 with various articles included in the play set of the present invention removeably attached thereto to simulate the appearance of a ballerina.

Having described the structures of the various components of the play set of the present invention, their use will now be described. Preferably, the play set is provided with at least one doll 10 and a plurality of articles 50 simulating lower body clothing, articles 70 and 80 simulating upper body clothing, and articles 90 simulating both headgear and coiffured natural hair. It is also preferable to embellish or ornament the various articles 50, 70, 80 and 90 and coifffure the strands 94 of artificial hair fixedly attached to the articles 90 to simulate various clothing fashions and hairstyles. If desired, such embellishments and ornamentation can include ribbon, lace, rickrack or other fabric items to simulate the texture of textile clothing and headgear. In such case, the user of the play set can select from among the various articles those articles which are appropriate and necessary to create a desired fashion and hairstyle appearance for the doll 10. For example, the appearance of a cowgirl is created by selecting the article 50' simulating a medium length western skirt, the article 80' simulating a matching vest and the article 90' simulating both a hat and braided natural hair illustrated in FIG. 11. In FIG. 12, the appearance of a princess is created by selecting the article 50'' simulating a long formal skirt and the article 90'' simulating both a decorative headband or tiara and long, curled natural hair which are illustrated. The appearance of a ballerina can be created by selecting the article 50''' simulating a short skirt and the article 90''' simulating both a decorative headband or tiara and upwardly brushed natural hair which are illustrated in FIG. 13.

While the present invention has been disclosed in connection with its preferred embodiment, it should be understood that there may be other embodiments which fall within the scope and spirit of the invention as defined by the claims.

We claim:

1. A fashion and hairstyle doll play set, comprising:

(a) a self-standing, three-dimensional doll having (i) a rigid or semi-rigid body with integrally formed limbs and indicia simulating clothing, said body being configured such that its arms extend out from the body and downward from its shoulders at essentially forty-five degree angles, its waist being in the form of a right circular cylinder, and its hips, legs and feet being dimensionally smaller than the diameter of its waist in all horizontal planes below its waist, and (ii) a semi-rigid or flexible head with an integrally formed sculptured hair design, said head having an essentially horizontal, encircling recess above the lower periphery of said sculptured hair design;

(b) at least one semi-rigid or flexible, hollow article simulating an article of lower body clothing, said article having a pair of opposed open ends, and, positioned in one of said open ends, an integrally formed ring which flexes to engage said waist of said body of said doll to removeably attach said article to said body of said doll; and (c) at least one article simulating both an article of headgear and coiffured natural hair, said article having a semi-rigid or flexible element which flexes to engage said recess above said lower periphery of said sculptured hair design of said head, and, fixedly attached to said element, coiffured strands of artificial hair.

2. A fashion and hairstyle doll play set as recited in claim 1, wherein said integrally formed ring positioned in one of said open ends of said article simulating an article of lower body clothing has an oval configuration.

3. A fashion and hairstyle doll play set as recited in claim 2, wherein said body of said doll has at least one protrusion above its waist which functions as a stop for said integrally formed ring when said ring engages said waist to removeably attach said article simulating an article of lower body clothing to said body of said doll.

4. A fashion and hairstyle doll play set as recited in claim 1, wherein said integrally formed ring positioned in one of said open ends of said article simulating an article of lower body clothing has a circular configuration with a pair of diametrically opposed, parallel, flat areas on its interior surface.

5. A fashion and hairstyle doll play set as recited in claim 4, wherein said body of said doll has at least one protrusion above its waist which functions as a stop for said integrally formed ring when said ring engages said article simulating an article of lower body clothing to said body of said doll.

6. A fashion and hairstyle doll play set as recited in claims 1, 2, 3, 4 or 5, further comprising at least one semi-rigid or flexible article simulating an article of upper body clothing, said article having a pair of parallel, U-shaped elements which flex to engage the shoulders of said body of said doll to removeably attach said article to said body of said doll.

7. A fashion and hairstyle doll play set as recited in claims 1, 2, 3, 4 or 5, further comprising at least one semi-rigid or flexible article simulating an article of upper body clothing, said article having a pair of parallel, U-shaped elements which flex to engage the shoulders of said body of said doll to removeably attach said article to said body of said doll, and wherein the back of said head of said doll has a sloped configuration to permit attachment of said article simulating an article of upper body clothing to said body of said doll from the rear thereof.

8. A fashion and hairstyle doll play set as recited in claims 1, 2, 3, 4 or 5, wherein said article simulating an article of lower body clothing has fabric attached thereto to simulate the texture of textile clothing.

9. A fashion and hairstyle doll play set as recited in claims 1, 2, 3, 4 or 5, wherein said article simulating both an article of headgear and coiffured natural hair has fabric attached to its semi-rigid or flexible element to simulate the texture of textile headgear.

* * * * *